US007591375B2

(12) United States Patent
Johnson

(10) Patent No.: US 7,591,375 B2
(45) Date of Patent: Sep. 22, 2009

(54) LAYERED VIBRATORY MATERIAL CONDITIONING APPARATUS

(75) Inventor: Eric Johnson, Edgewood, KY (US)

(73) Assignee: M-I L.L.C., Houston, TX (US)

( * ) Notice: Subject to any disclaimer, the term of this patent is extended or adjusted under 35 U.S.C. 154(b) by 166 days.

(21) Appl. No.: 11/477,031

(22) Filed: Jun. 28, 2006

(65) Prior Publication Data

US 2007/0045158 A1 Mar. 1, 2007

Related U.S. Application Data

(60) Provisional application No. 60/694,536, filed on Jun. 28, 2005.

(51) Int. Cl.
*B03B 9/06* (2006.01)

(52) U.S. Cl. ..... 209/11; 209/3; 209/3.2; 209/238; 209/311; 209/315

(58) Field of Classification Search ..... 209/3, 209/3.2, 11, 238, 311, 315, 353, 357
See application file for complete search history.

(56) References Cited

U.S. PATENT DOCUMENTS 2,753,999 A * 7/1956 Mathewson et. al. ..... 209/403
3,794,165 A * 2/1974 Riesbeck et al. ..... 209/325
4,125,945 A * 11/1978 Westelaken ..... 34/65
4,257,168 A 3/1981 Carroll et al.
4,415,444 A 11/1983 Guptail
4,443,332 A 4/1984 de Nevers
4,686,779 A * 8/1987 Wyatt et al. ..... 34/168
4,785,554 A * 11/1988 Hederer et al. ..... 34/164
5,199,184 A * 4/1993 Rosse ..... 34/370
6,230,421 B1 * 5/2001 Reed et al. ..... 34/401
6,439,391 B1 8/2002 Seyffert

* cited by examiner

*Primary Examiner*—Patrick H MacKey
*Assistant Examiner*—Terrell H Matthews

(57) ABSTRACT

A vibratory conditioner includes a plurality of screens having a planar surface through which there is a material feed opening, wherein each screen is retained in vertical alignment such that all planar surfaces are parallel, a chamber within which the parallel screens are retained, means for conditioning air within the chamber to a predetermined temperature and a predetermined humidity level, and a vibratory generator operable to vibrate the chamber and fluidize particles of material retained on a top surface of each screen and to move the fluidized particles in a first direction.

19 Claims, 8 Drawing Sheets

LAYERED VIBRATORY MATERIAL CONDITIONING APPARATUS

This application claims priority to Provisional Patent Application Ser. No. 60/694,536 filed on Jun. 28, 2005 and entitled, "Layered Vibratory Material Conditioning Apparatus" incorporated herein by reference for all purposes.

BACKGROUND OF THE INVENTION

Many industries, such as pharmaceutical, food, plastic, and waste, require material particles to be exposed to predetermined conditions, such as heat or cold, as a part of an overall process. Various types of equipment have been developed to integrate the conditioning of particles with other production processes.

One such apparatus dries product as the product is gradually moved across conveying surfaces towards the apparatus discharge. The conveying surfaces are porous and enclosed within a vibrating vessel. The vibrations fluidize the particles and cause them to move forward through the apparatus. Air flow normal to the direction of particle flow provides heated or cooled air through the porous surface and the product. Such a single deck, rectangular design requires many square feet of valuable production space.

Alternative designs have attempted to reduce the square footage of production space required to condition material. One such design uses a stack of non-vibrating, slowly rotating trays. Material to be conditioned is dropped onto a top tray having several slots providing fluid communication to a lower tray. As the tray of material rotates within a conditioned chamber, a wiper pushes material through one of the slots in the tray. The material from the top tray then drops onto a second tray where the same action is repeated. The material continues to be wiped into slots on successive trays until it is released through a discharge spout at the bottom of the apparatus. While this utilizes less square footage than the first apparatus and provides longer exposure of the material to the predetermined conditions, the trays do not allow vertical air flow through the particles. Further, the trays do not integrate material separation with conditioning.

It would be an improvement in the art to have a material conditioner that uses minimal floor space. It would be a further improvement in the art to have a material separator that could be adapted to segregate oversized and/or undersized particles of material as the material is being conditioned.

SUMMARY

In a first aspect of the invention, a vibratory conditioner includes a plurality of screens having a planar surface through which there is a material feed opening, wherein each screen is retained in vertical alignment such that all planar surfaces are parallel, a chamber within which the parallel screens are retained, means for conditioning air within the chamber to a predetermined temperature and a predetermined humidity level, and a vibratory generator operable to vibrate the chamber and fluidize particles of material retained on a top surface of each screen and to move the fluidized particles in a first direction.

In another aspect of the invention, an apparatus for conditioning and classifying material includes a plurality of screens retained within the chamber, wherein each screen has a center orifice and an outer edge, with a material feed opening radially extending through the screen, wherein each porous element has a plurality of pores of a unique predetermined pore size, a cylindrical connector affixed within the center orifice of each of the plurality of screens, wherein each connector interconnects with adjacent cylindrical connectors to retain each screen in a fixed rotational alignment such that the material feed opening through adjacent screens are offset by a fixed offset angle, a vibratory generator operable to vibrate the chamber and fluidize the material on each screen, thereby causing it to move in a first direction, and means for conditioning air within the chamber.

In another aspect of the invention, a method for conditioning and classifying particles includes conditioning air in a chamber to a predetermined temperature and a predetermined humidity level, circulating the conditioned air within the chamber, dispensing a plurality of particles into the chamber and onto a first of a plurality of vertically adjacent screens, wherein each porous element has a plurality of pores of a unique predetermined size and a radially extending material feed opening, and wherein the material feed opening of adjacent screens are offset from each other, vibrating the screens to separate particles having a particle size greater than a desired minimum particle size from particles having a particle size less than the desired minimum particle size, directing the particles having a particle size greater than the desired minimum particle size to subsequent screens through the material feed opening in each porous element, collecting the particles having a particle size less than the desired minimum particle size at a bottom portion of the chamber.

Other aspects and advantages of the claimed subject matter will be apparent from the following description and the appended claims.

DETAILED DESCRIPTION

Figure 1:
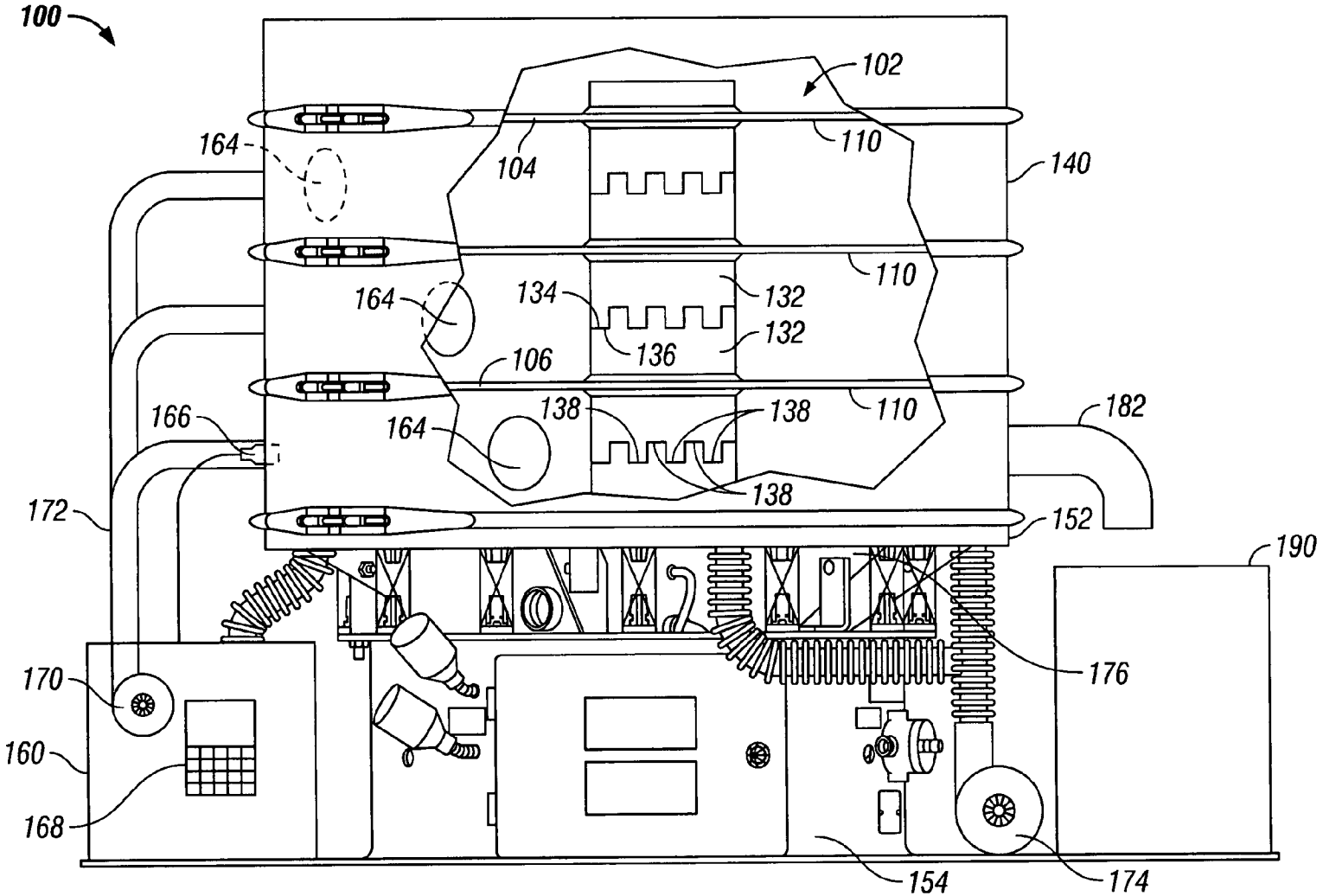
FIG. 1 is a cutaway side view of a vibratory conditioning apparatus.

The claimed subject matter relates to an apparatus for conditioning material. Referring to FIG. 1, the inventive vibratory conditioner 100 includes a plurality of screens 110, a chamber 140, a means for conditioning the air 160 within the chamber 140 to predetermined parameters, and a vibratory generator 176. The plurality of screens 110 are retained within the chamber 140. The means for conditioning air 160 is operative to bring the temperature and humidity levels within the chamber 140 to predetermined levels. The chamber 140 is mounted to a base 154 in a conventional manner by means of resilient members (not shown). The vibratory generator 176, of conventional design, is securely mounted within the housing floor 152 of the chamber 140 and is operative to fluidize material on screens 110 within the chamber 140.

Figure 2:
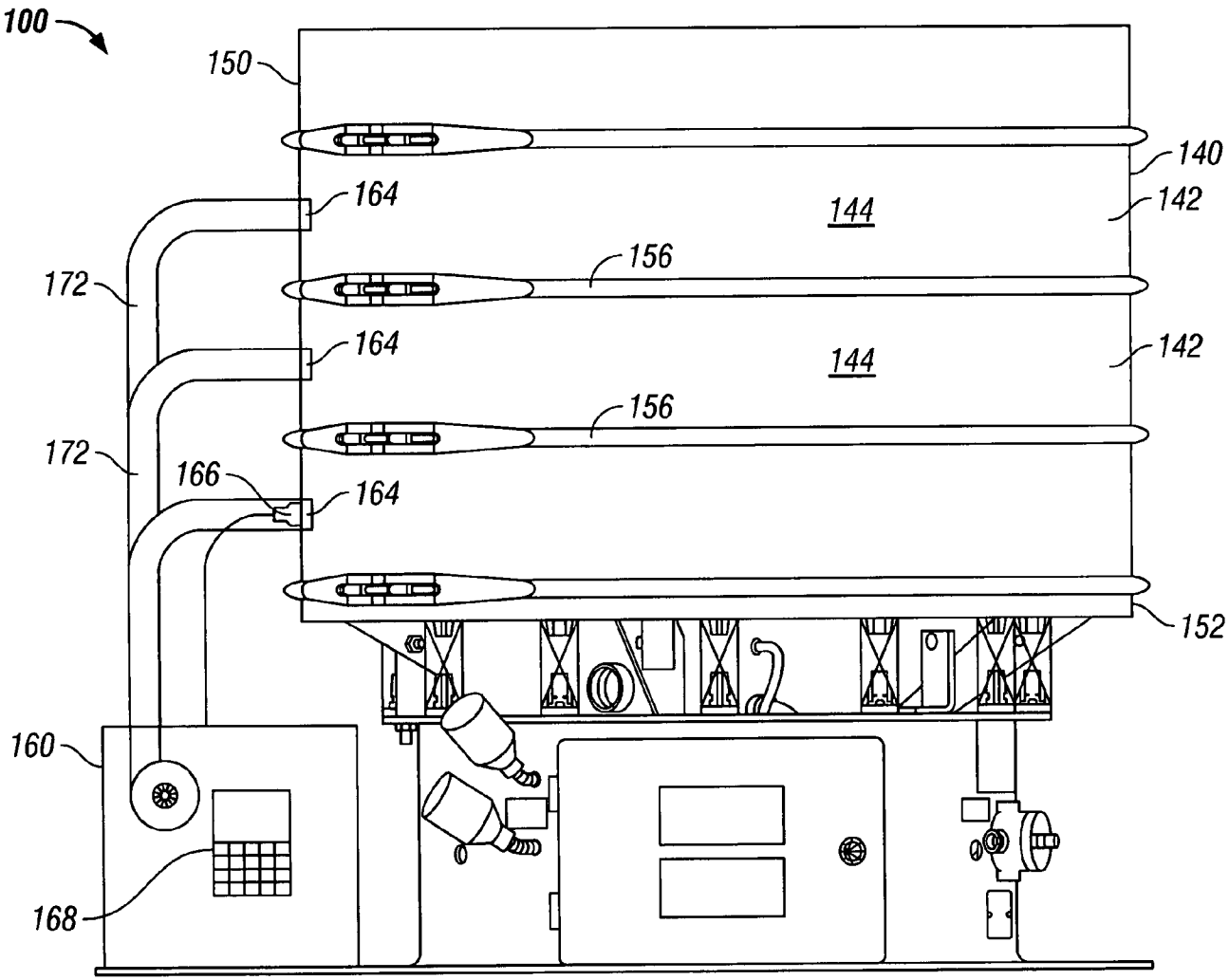
FIG. 2 is a side view of the housing of the vibratory conditioning apparatus.
Figure 5:
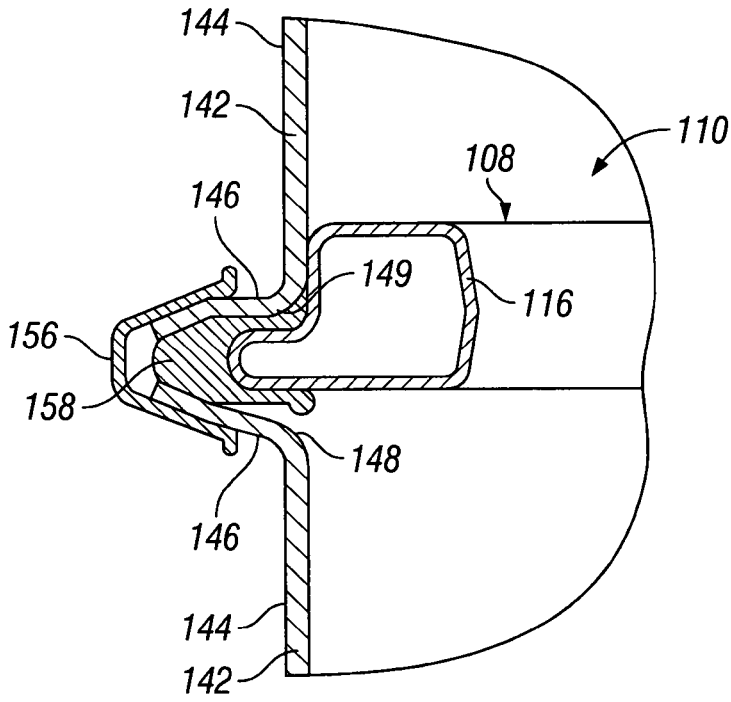
FIG. 5 is a cross sectional detail of a screen frame retained by the housing.

The chamber 140 is depicted in FIG. 2 and includes a plurality of housing components 142, a cover 150, and a housing floor 152. Referring to FIGS. 2 and 5, housing components 142 preferably are cylindrical defined by a housing wall 144 with an outwardly protruding flange 146 around each of the upper edge 148 and the lower edge 149. As will be described, a screen 110 may be retained between flanges 146 of two adjacent housing components 142. A clamp band 156 may be used around the outer periphery of the adjacent flanges 146 to secure one housing component 142 to the next with a screen 110 retained between them. By affixing several housing components 142 together with a screen 110 retained between housing components 142, a screen stack 102 is created (see FIG. 1).

The screen stack 102 may be formed from any number of screens 110. In discussing the relationship of screens 110 within the screen stack 102, it is understood that there is a top screen 104 and a bottom screen 106. It is further understood that in discussing the relation of two screens 110 within the screen stack 102, there is an upper screen and a lower screen. For screens 110 located between the top screen 104 and the bottom screen 106, each screen can be an upper screen and a lower screen, relative to the next adjacent screen above or below, respectively.

Figure 3:
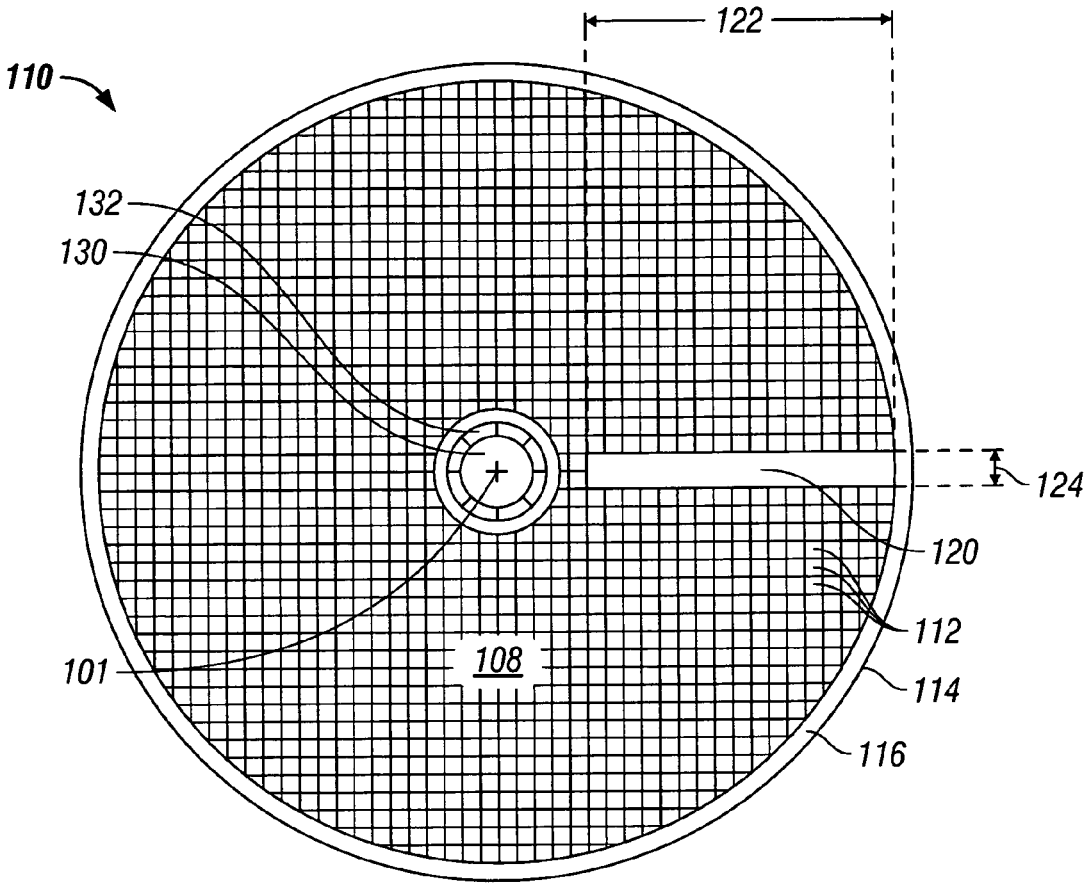
FIG. 3 is a top view of a screen of the vibratory conditioning apparatus.
Figure 4:
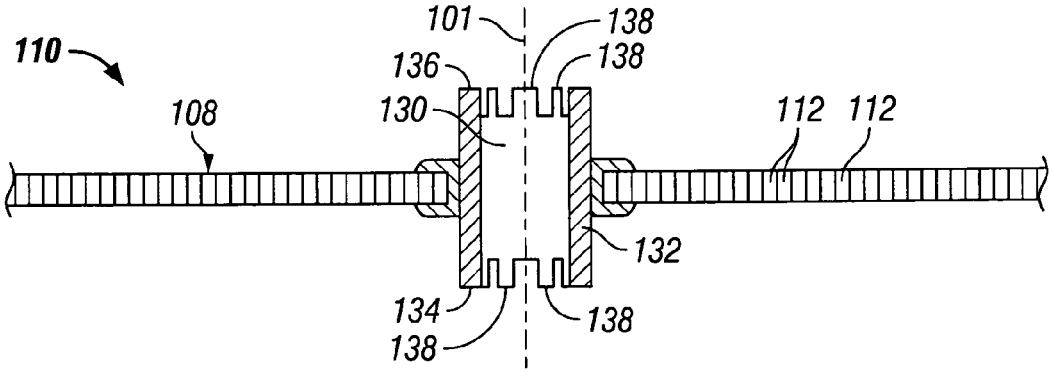
FIG. 4 is a cross sectional view of a screen of the vibratory conditioning apparatus.

Referring to FIGS. 1, 3 and 4, each screen 110 is planar and has a plurality of pores 112 of a predetermined size. Material is retained on a screen top surface 108. The pores 112 increase the exposure of the material to the environmental conditions within the chamber 140. The screens 110 are preferably round, but may be square or rectangular to match the interior shape of chamber 140.

Referring to FIGS. 3, 4, and 5, screens 110 have an screen periphery 114, at which there is a screen frame 116. As shown in FIG. 5, screen frame 116 is retained between adjacent housing components 142. Preferably, a gasket 158 is located between the screen frame 116 and the housing component flanges 146 to seal the interface.

A material feed opening 120 is present through each screen 110 and radially extends along a portion of the screen 110 for an opening length 122. The material feed opening 120 has an opening width 124 sufficient to allow material retained on screen top surface 108 to pass through the upper screen 110 onto the lower adjacent screen 110 or to a collection area 190 (shown in FIG. 1).

Figure 6:
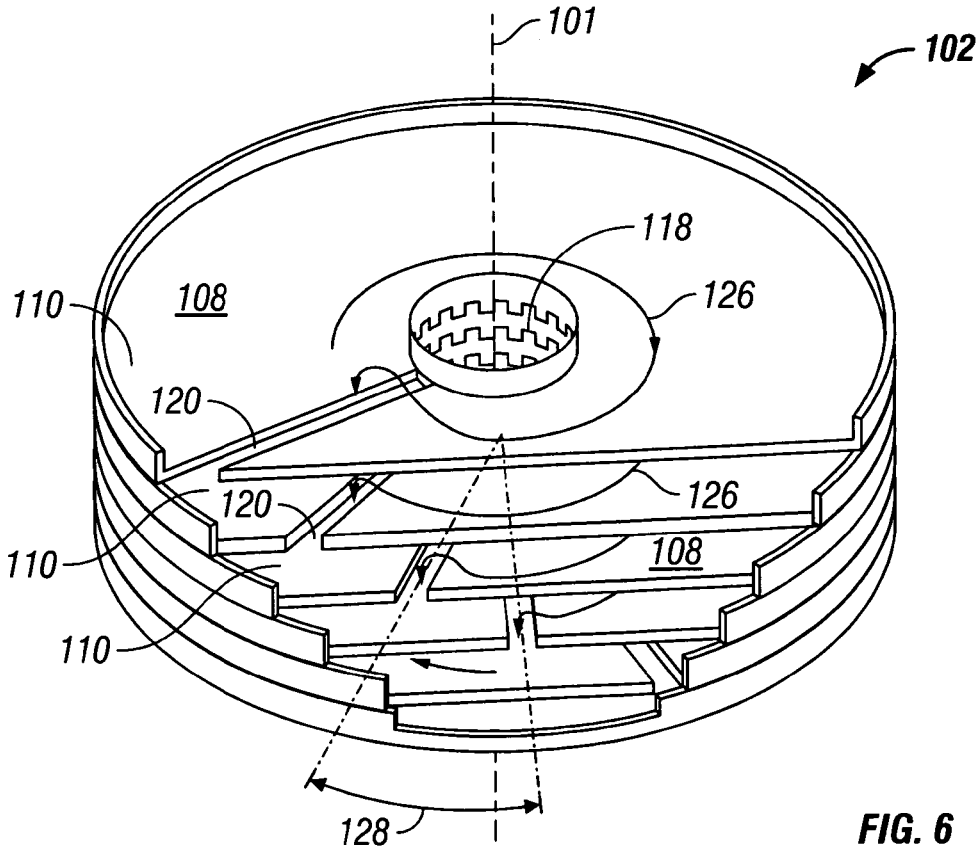
FIG. 6 is a perspective view of the screen stack.

Referring to FIG. 6, the material feed opening 120 of each screen 110 is offset from the material feed opening 120 of adjacent screens 110. That is, the material feed opening 120 of each lower screen 110 is positioned behind the material feed opening 120 of the adjacent upper screen 110 relative to the flow direction 126 of material around the screen 110. Thus, material dropping onto a lower screen 110 from above must travel along the screen top surface 108, around screen center 118, for a predetermined distance. The offset angle 128 between material feed openings 120 of adjacent screens 110, as measured in the flow direction 126, will be less than 360 degrees and should be more than 270 degrees to ensure that the material has had adequate exposure to the environmental conditions introduced into the chamber 140.

As shown in FIGS. 1, 3, and 4, each screen 110 has a center orifice 130 through which a cylindrical retainer 132 is affixed. The cylindrical retainers 132 provide a circular path for the material to follow by blocking a path to the material feed opening 120 across the center of the screen 110. Also, stability to the screen 110 is added by the cylindrical retainer 132 as a lower retainer edge 134 of each cylindrical retainer 110 rests on an upper retainer edge 136 of a lower adjacent cylindrical retainer 110. Further, the cylindrical retainers 132 hold each screen 110 in a fixed rotational alignment, thereby preserving the offset angle 128 of each adjacent material feed opening 120. To maintain the offset angle 128 of the material feed openings 120 of adjacent screens 110, the cylindrical retainers 132 may include castellations 138 positioned around the retainer upper edges 136 and retainer lower edges 134. The castellations 138 along the lower retainer edge 134 of the cylindrical retainer 132 on an upper screen 110 are held between the castellations 138 along the upper retainer edge 136 of the cylindrical retainer 132 of the adjacent lower screen 110. The castellations 138 ensure that no screen 110 rotates about a center axis 101 relative to the remaining screens 110 in the screen stack 102.

Figure 7A:
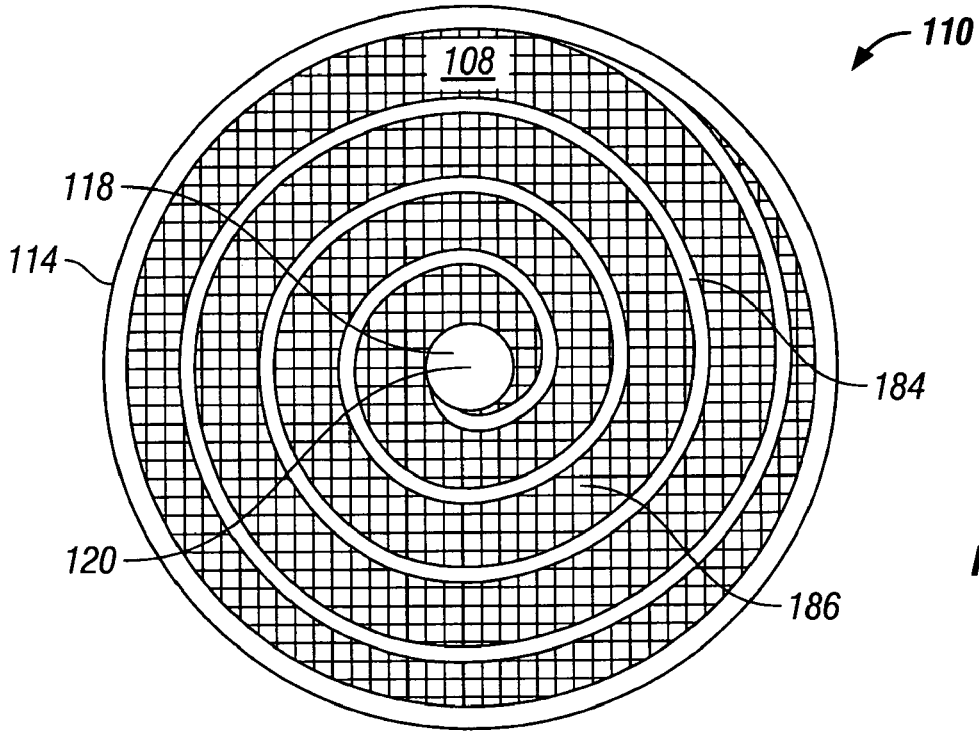
FIGS. 7A and 7B depict flow paths in opposite directions.
Figure 7B:
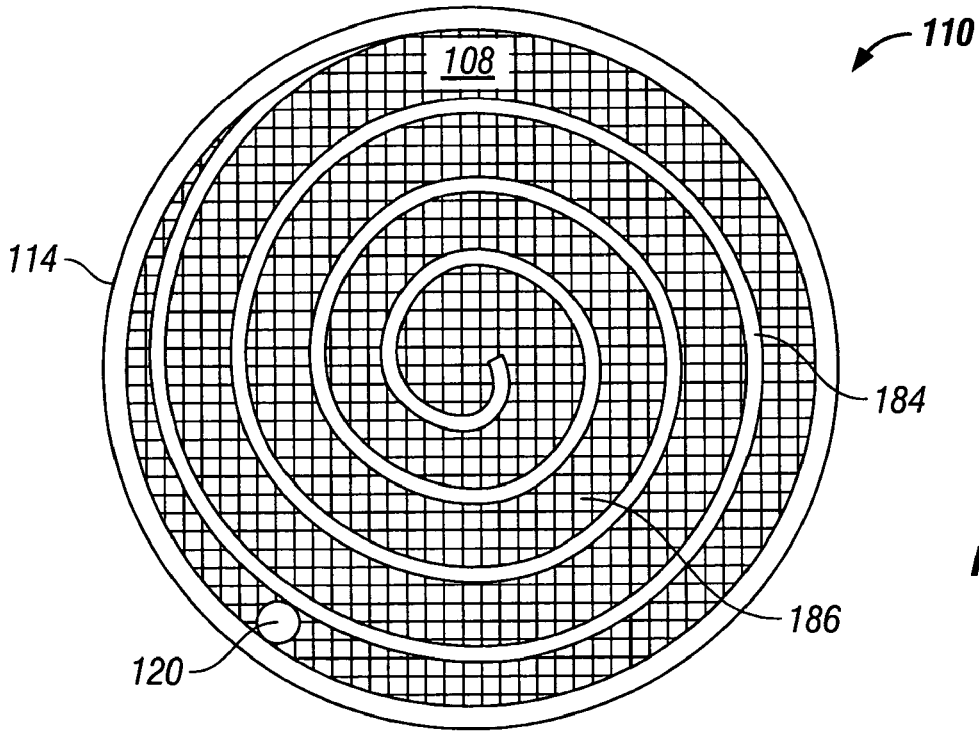

As shown in FIGS. 7*a* and 7*b*, a spiral baffle 184 may be included on the one or more of the screens 110. The spiral baffle 184 creates a spiral path 186 extending from the screen center 118 to the screen periphery 114 (as shown in FIG. 7*b*) or from the screen periphery 114 toward the screen center 118 (as shown in FIG. 7*a*). The fluidized material is directed by the spiral baffle 184 around the screen top surface 108 of the top screen 104, thereby providing additional exposure to the conditioning provided by the means for conditioning air 160. The material feed opening 120 may extend across a portion of the spiral path 186 that is adjacent to the screen periphery 114, as in FIG. 7*b*, or that is adjacent to the screen center 118, as shown in FIG. 7*a*. Adjacent screens 110 may include reversed paths 184 to maximize the exposure of the material to the conditioning. For example, the screen 110 shown in FIG. 7*b* may be the top screen 104, while the screen 110 shown in FIG. 7*a* is below the top screen 104. Thus, material directed to the top screen 104 may be conveyed along path 186 to the material feed opening 120 adjacent to the screen periphery 114. The material dropped through material feed opening 120 on the top screen 104 is then directed along the path 186 of the second screen 110 from the screen periphery 114 to the material feed opening 120 near the screen center 118.

Figure 8:
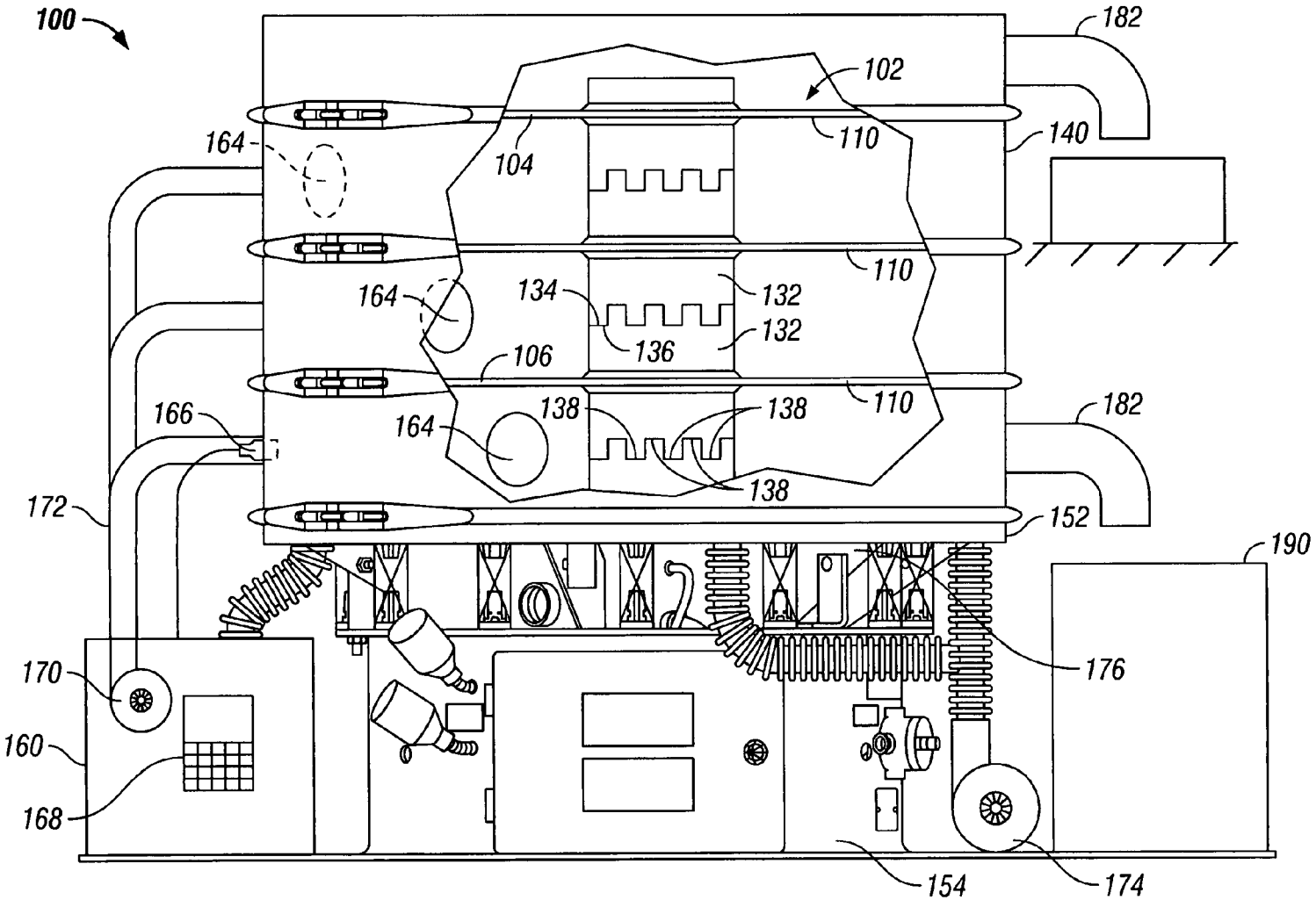
FIG. 8 is a cutaway side view of a vibratory conditioning apparatus with overs removal.
Figure 9:
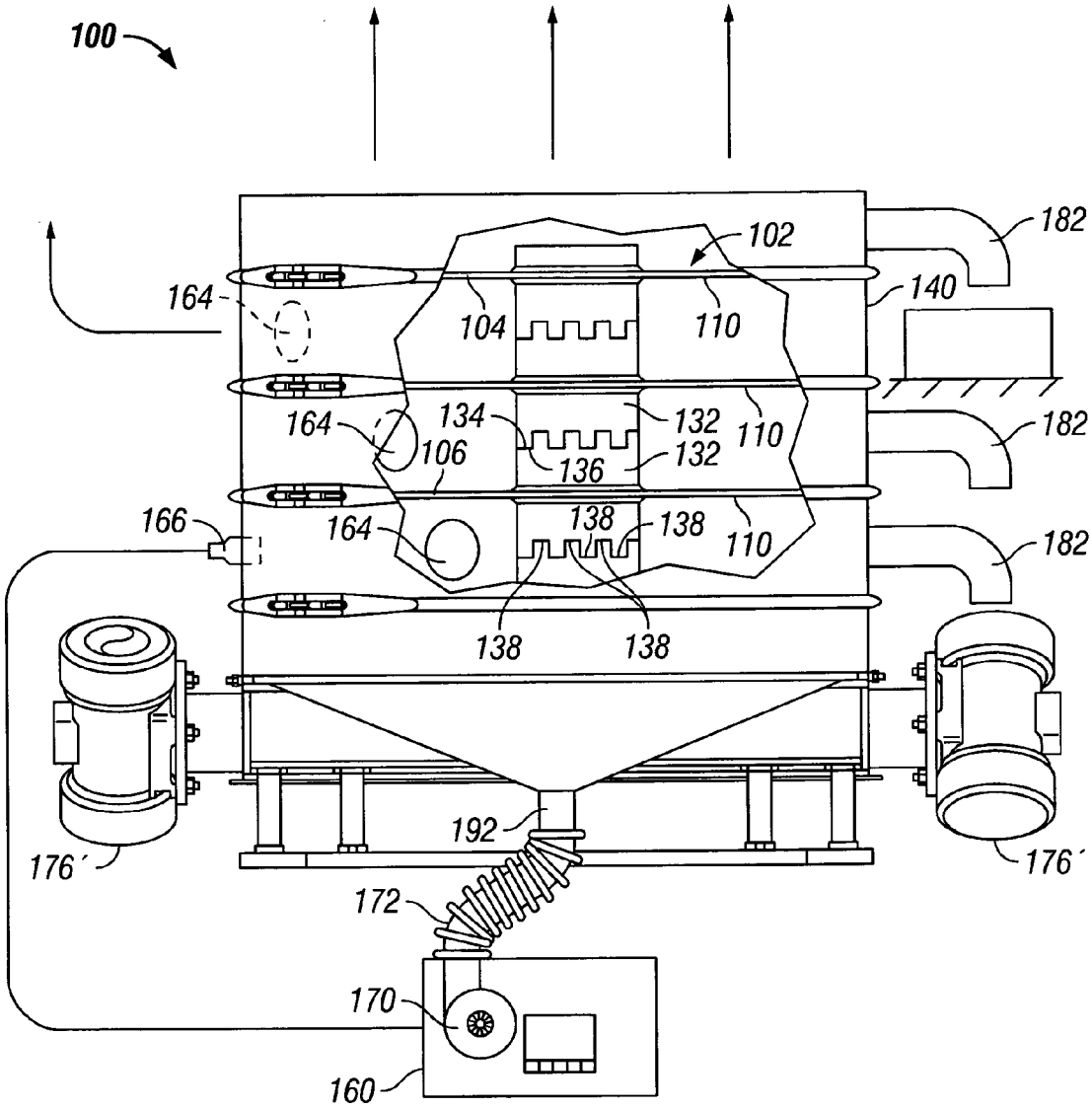
FIG. 9 is cutaway side view of a vibratory conditioning apparatus with low profile vibratory drives.

Referring to FIGS. 1, 2, and 8, the means for conditioning air 160 within chamber 140 brings the air to a predetermined temperature and humidity level. The predetermined temperature and/or humidity level may be programmed by an operator. The means for conditioning air 160 may include heating and/or cooling units, humidifiers, and/or dehumidifiers. The means for conditioning air 160 may be retained at a location external to chamber 140 with ducts 172 providing conditioned air to the chamber 140 via vents 164 through housing wall 144 or housing floor 152. An alternative arrangement is shown in FIG. 9, in which a set of low profile dual motors 176' are used to vibrate the chamber 140 rather than the more typical vibratory drive associated with round separators as shown in FIG. 1 as 176. By including a set of low profile dual motors 176, a central air pipe 192 may be utilized to introduce conditioned air to the chamber 140. This has the advantage of providing a more uniform air flow within the chamber 140.

The means for conditioning air 160 within chamber 140 may also include one or more sensors 166 and a controller 168. The sensors 166 measure the air temperature and/or humidity level within chamber 140. The controller 168 receives data from the sensor 166 and operates components of the means for conditioning air 160, such as a heater, cooling unit, humidifier, and/or dehumidifier in response to collected measurements to maintain the predetermined temperature and humidity level within the chamber 140 as measured by the sensor 166.

A means for circulating air 170 within chamber 140 may be included to move conditioned air between and among screens 110, subjecting material on each screen 110 to the desired air temperature and humidity. The means for circulating air 170 may include a fan or blower to force air from the means for conditioning air 160 through one or more air ducts 162 and vents 164 through housing wall 144 and/or housing floor 152. Alternatively, a vacuum may be used to pull conditioned air through the chamber 140, thereby exposing particles to the conditioned air.

The vibratory conditioner 100 may also include a means for dedusting particles 174, wherein dust from the particles retained on the top screen surfaces 108 is periodically removed. Means for dedusting particles 174 may include a blower and vacuum system that provides an air current through the chamber of sufficient strength to separate fine particles that are adhered to more coarse particles and evacuated the fine particles from the chamber 140. Preferably, a vertical airflow is provided through the chamber 140 to dedust the particles therein. The same blower may be used to dedust particles and to circulate air during processing of the material. The airflow for dedusting particles may have a faster velocity than the airflow for circulating conditioned air when the same blower is used for both functions.

As previously stated, the vibratory generator 176 is operable to fluidize material on the screens 110. The housing floor 152 of the chamber 140 securely mounts to the vibratory generator 176. The vibratory generator 140 imparts motion to the material on each screen top surface 108 such that the individual particles of material are fluidized and conveyed around the screen 110. The fluidized material is led by the vibratory generator 176 such that it spirals outward from the center axis 101 in a first direction. As the particles reach the material feed opening 120, they are gravity fed onto the lower sequential screen 110.

Figure 10:
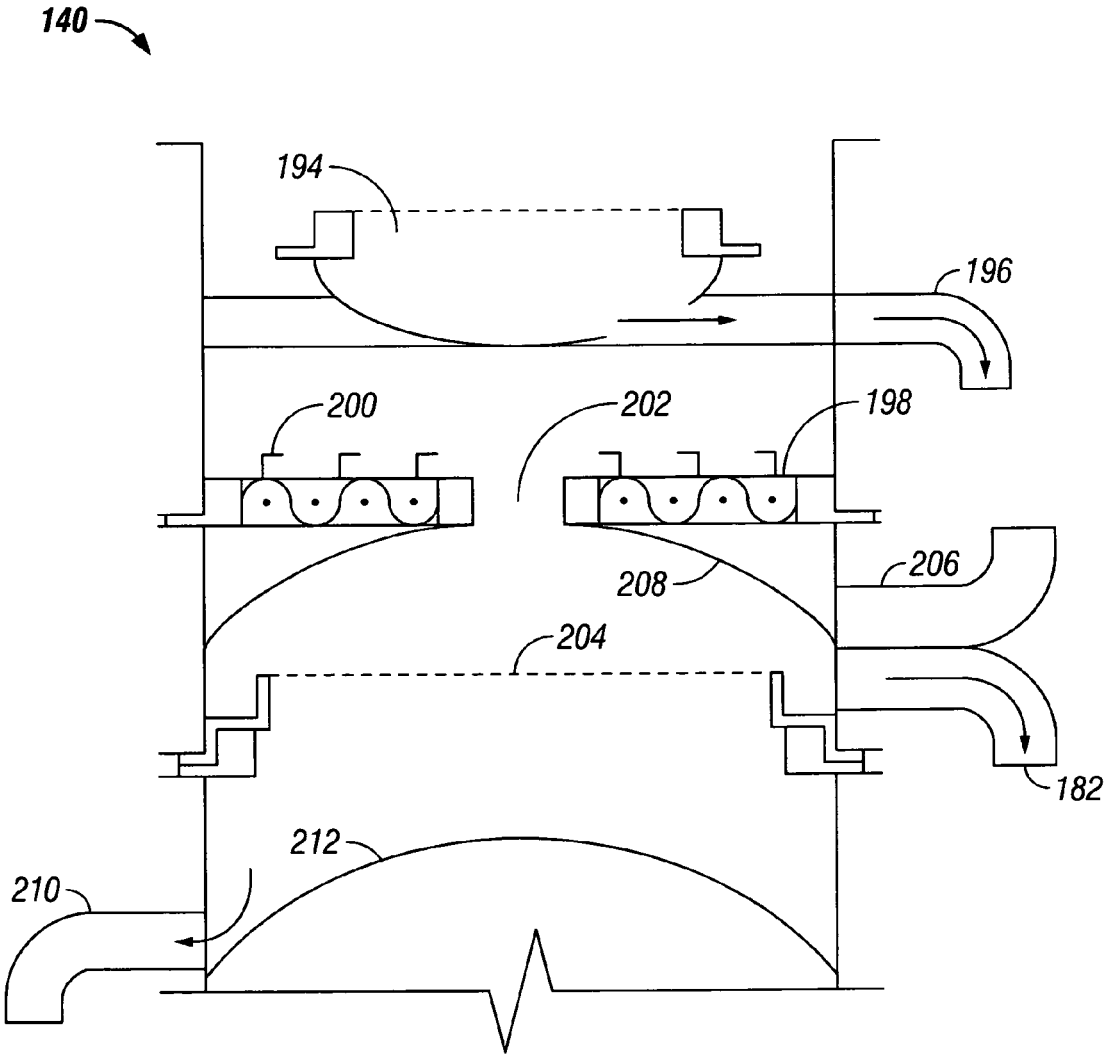
FIG. 10 is an embodiment of the vibratory conditioning apparatus.

Referring to FIG. 10, the chamber 140 may be configured such that a dedusting deck 194 is provided at the top of the chamber 140. After material is transferred onto the dedusting deck 194, the dedusting process takes place and dust may be removed through a dust removal spout 196. A cooling deck 198 may be provided beneath the dedusting deck 194. The cooling deck 198 may include a spiral baffle 200 to cool the product as it is transferred around the screen of the cooling deck 198 to a center hole 202. An air inlet 206 directs conditioned air into the chamber 140 beneath the cooling deck 198. A directing baffle 208 guides the conditioned air from the air inlet 206 upward to flow through the cooling deck screen 198. The conditioned material may then drop to a perforated plate or screen 204 having a predetermined mesh size to separate oversized material from the product being transferred through the screen. The oversized material remains on the top surface of the screen 204 until the vibratory motion imparted to the chamber 140 eventually causes the oversized material to be removed from the chamber 140 through an overs spout 182'. The product, which has been dedusted, conditioned and separated from oversized material falls through the plate or screen 204 and may be removed through a product outlet spout 210. A chamber floor 212 may be formed to have an arced profile, such as that shown, to facilitate removal of the product through the product outlet spout 210.

Returning to FIGS. 1, 2, and 8, the vibratory generator 176 may include a reversible drive system. The reversible drive system provides a reverse flow direction to the particles on the screen top surface 108. When the flow is reversed, particles still spiral outward from the center axis 101, however the path is in a second direction, opposite the first direction.

By varying the size of the pores 112 in subsequent screen layers, sorting by particle size may also be accomplished as material is conditioned. If classification of particles is incorporated into the vibratory conditioner 100, through appropriately sized pores 112, particles having a particle size less than the pore size of the screen fall through the pores 112 to the adjacent lower screen 110 or to the housing floor 152. Likewise, particles having a particle size greater than the pore size of the screen 110 are moved along the screen top surface 108 as the screen 110 is vibrated. The pore size of each screen 110 in the screen stack 102 may be unique, wherein the pores 112 of each screen 110 are of a different size than the pores 112 of other screens 110 within the chamber 140.

In a first example, all screens 110 have a common pore size, wherein each pore 112 is of a size sufficient to retain a particle having a particle size equal to or greater than the smallest acceptable particle size on the screen top surface 108 of the screen 110. Particles having a particle size greater than the pore size are retained on the screen top surface 108 of the top screen 104 until reaching the material feed opening 120. Material deposited onto the second screen 110 is, likewise, retained on the screen top surface 108 until reaching the material feed opening 120 of the second screen 110. In this manner, particles having a particle size greater than the pore size of the screens 110 continue to be conditioned as they are transferred along the screen top surface 108. Particles having a particle size less than the smallest allowable particle size fall through successive screens 110 until reaching a collection area 190 on or near housing floor 152. The undersized particles are then segregated from the particles having the desired particle size.

A modification of the first example would be to remove the undersized material before beginning the conditioning process. This may be accomplished by vibrating the chamber to remove the undersized particles, that is, to dedust the acceptable particles. After removing the undersized particles, conditioned air may be introduced to the chamber and the vibratory direction modified to convey acceptable material over the screen top surface 108 to the material feed opening 120.

In a second example of simultaneous sorting and conditioning of material, a top screen 104 has pores 112 of a size through which particles having the maximum acceptable particle size may pass. Thus, oversized particles are retained on the top screen 104 and may be removed by a spout 182 or other removal system. Particles having a particle size less than the maximum acceptable size pass through the top screen 104 to the second screen 110. The second screen 110 is sized to retain particles having an acceptable particle size on the screen top surface 108 until the particles have reached the material feed opening 120. Subsequent screens 110 in the screen stack 102 also maintain the particles having an acceptable particle size on the screen top surface 108, thereby providing additional exposure of the environmental conditions to the acceptable particles.

The third example is a combination of the first two examples. The top screen 104 may have pores 112 of a size sufficient to retain oversized particles on the screen top surface 108. The oversized particles on the top screen 104 are removed. Undersized particles and particles having a size within an acceptable range pass through the pores 112 of the top screen 104 onto the second screen 110. All of the subsequent screens 110 may have pores 112 of a size sufficient to permit the passage of undersized particles. The undersized particles are collected in an undersized particle collection area 190 on or near the housing floor 152. Particles having a particle size within the acceptable range are transferred along the screen top surface 08 of each successive screen 110 until passing through the respective material feed opening 120 to the next screen 110 or the finished product collection area 190.

In a fourth example, wet material may be retained on a top screen 104 and subjected to a drying environment in the chamber. As the material dries, it may separate or shrink, depending upon the material involved. After the material has separated into particles of less than a predetermined size or after the material has reduced in size to less than a predetermined size, the material can pass through the top screen. Sequential screens may have decreasingly smaller pore sizes, requiring additional drying time for material to pass therethrough. In this manner, the level of dryness of a particular material may be determined based upon the screen on which the material is present at any time. The level of dryness desired for a material and the particle size variation during the drying process can be used to determine the number of sequential screens required to sufficiently dry the material.

While the claimed subject matter has been described with respect to a limited number of embodiments, those skilled in the art, having benefit of this disclosure, will appreciate that other embodiments can be devised which do not depart from the scope of the claimed subject matter as disclosed herein. Accordingly, the scope of the claimed subject matter should be limited only by the attached claims.

What is claimed is:

1. A vibratory conditioner comprising:

a plurality of screens having a planar surface through which there is a material feed opening, wherein each screen is retained in vertical alignment such that all planar surfaces are parallel;

a plurality of flow directors beneath the material feed opening of each screen to direct material to a point on a lower screen such that the material is directed around the screen before reaching the material feed opening therein;

a chamber within which the plurality of parallel screens are retained;

means for conditioning air within the chamber to a predetermined temperature and a predetermined humidity level; and a vibratory generator operable to vibrate the chamber and fluidize particles of material retained on a top surface of each screen and to move the fluidized particles in a first direction;

wherein the plurality of screens have a plurality of pores of a unique predetermined pore size configured to segregate undersized particles from acceptable sized particles.

2. The vibratory conditioner of claim 1, further comprising: means for humidifying air within the chamber to a predetermined humidity level.

3. The vibratory conditioner of claim 1, wherein the means for conditioning air within the chamber comprises: a heater operable to heat the air within the chamber; a sensor to detect when the air within the chamber has reached a predetermined temperature; a controller operable to receive data from the sensor and to operate the heater to maintain the predetermined temperature within the chamber.

4. The vibratory conditioner of claim 3, wherein the means for conditioning air within the chamber further comprises; a humidifier operable to add moisture to the air within the chamber; wherein the sensor can further detect when the air within the chamber has reached a predetermined humidity level; and wherein the controller is further operable to receive data from the sensor and operate the humidifier to maintain the predetermined humidity level within the chamber.

5. The vibratory conditioner of claim 4, further comprising; a means for circulating the conditioned air within the chamber.

6. The vibratory conditioner of claim 5, wherein the means for circulating the conditioned air within the chamber comprises: a fan.

7. The vibratory conditioner of claim 1, wherein the means for conditioning air within the chamber comprises: a chiller operable to reduce the temperature of the air within the chamber; a sensor to detect when the air within the chamber has reached a predetermined temperature; a controller operable to receive data from the sensor and to operate the chiller to maintain the predetermined temperature within the chamber.

8. The vibratory conditioner of claim 7, wherein the means for conditioning air within the chamber further comprises: a heater operable to heat the air within the chamber; wherein the sensor further detects when the air within the chamber has reached a predetermined temperature; and wherein the controller is further operable to receive data from the sensor and to operate the heater to maintain the predetermined temperature within the chamber.

9. The vibratory conditioner of claim 8, further comprising: a humidifier operable to add moisture to the air within the chamber; a second sensor operable to detect when the air within the chamber has reached a predetermined humidity level; and wherein the controller is further operable to receive data from the sensor and operate the humidifier to maintain the predetermined humidity level within the chamber.

10. The vibratory conditioner of claim 1, wherein the material feed opening of each screen is offset from the material feed opening of adjacent screens.

11. The vibratory conditioner of claim 10, further comprising: a cylindrical retainer holding each screen in fixed rotational alignment relative to adjacent screens such that the material feed opening in each porous element is an offset angle from the material feed opening of each adjacent screen.

12. The vibratory conditioner of claim 1, wherein the vibratory generator comprises: a reversible drive operable to fluidize particles of material retained on the top surface of each screen in a second direction within the chamber, wherein the second direction is opposite the first direction.

13. An apparatus for conditioning and classifying material comprising:

a chamber;

a plurality of screens retained within the chamber, wherein each of the plurality of screens has a center orifice and an outer edge, wherein at least one of the plurality of screens comprises a material feed opening radially extending through the screen, wherein each of the plurality of screens has a plurality of pores of a unique predetermined pore size configured to segregate undersized particles from acceptable sized particles;

wherein the screens are vertically arranged such that particles greater than a desired maximum particle size are retained on a top side of an uppermost screen;

a spout in fluid communication with the top side of the uppermost screen, wherein the spout directs the particles greater than the desired maximum particle size to an oversized particle collection area external to the chamber;

a cylindrical connector affixed within the center orifice of each of the plurality of screens, wherein each connector interconnects with adjacent cylindrical connectors to retain each screen in a fixed rotational alignment such that the material feed opening through adjacent screens are offset by a fixed offset angle;

a vibratory generator operable to vibrate the chamber and fluidize the material on each screen, thereby causing it to move in a first direction; and means for conditioning air within the chamber; and means for conditioning air within the chamber.

14. An apparatus for conditioning and classifying material comprising:

a chamber;

a plurality of screens retained within the chamber, wherein each of the plurality of screens has a center orifice and an outer edge, wherein at least one of the plurality of screens comprises a material feed opening radially extending through the screen, wherein each of the plurality of screens has a plurality of pores of a unique predetermined pore size configured to segregate undersized particles from acceptable sized particles;

an undersized particle collection area located beneath a lowermost screen, wherein particles having less than a desired minimum particle size are collected in the undersized particle collection area;

a spout in fluid communication with a top side of an uppermost screen, wherein particles greater than a desired maximum particle size are retained on the top side of the uppermost screen; and wherein the spout directs the particles greater than the desired maximum particle size to an oversized particle collection area external to the chamber a cylindrical connector affixed within the center orifice of each of the plurality of screens, wherein each connector interconnects with adjacent cylindrical connectors to retain each screen in a fixed rotational alignment such that the material feed opening through adjacent screens are offset by a fixed offset angle;

a vibratory generator operable to vibrate the chamber and fluidize the material on each screen, thereby causing it to move in a first direction; and means for conditioning air within the chamber; and means for conditioning air within the chamber.

15. A method for conditioning and classifying particles comprising:

conditioning air in a chamber to a predetermined temperature and a predetermined humidity level;

circulating the conditioned air within the chamber;

dispensing a plurality of particles into the chamber and onto a first of a plurality of vertically adjacent-screens, wherein each porous element of the plurality of screens has a plurality of pores of a unique predetermined size configured to segregate undersized particles from acceptable sized particles, wherein at least one of the plurality of screens comprises a radially extending material feed opening, and wherein the material feed opening of adjacent screens are offset from each other;

vibrating the screens to separate and remove particles having a particle size greater than a desired minimum particle size from the particles having a particle size less than the desired minimum particle size;

directing the plurality of particles having a particle size greater than the desired minimum particle size to subsequent screens through the material feed opening in the at least one of the plurality of screens; and collecting the particles having a particle size less than the desired minimum particle size at a bottom portion of the chamber.

16. The method of claim 15, further comprising: collecting the particles having a particle size greater than a desired maximum particle size at a location external to the chamber.

17. The method of claim 15, further comprising: dedusting the particles prior to vibrating the screens.

18. The method of claim 17, further comprising: providing vertical airflow to dedust the particles.

19. The method of claim 15, further comprising: dedusting the particles while vibrating the screens.

* * * * *